United States Patent [19]

Wing et al.

[11] 4,279,081

[45] Jul. 21, 1981

[54] WALLBOARD T-SQUARE

[75] Inventors: Steven D. Wing, East Amherst; Richard E. Smith, Williamsville, both of N.Y.

[73] Assignee: National Gypsum Company, Dallas, Tex.

[21] Appl. No.: 81,138

[22] Filed: Oct. 2, 1979

[51] Int. Cl.[3] ..... B43L 7/02
[52] U.S. Cl. ..... 33/479
[58] Field of Search ..... 33/479, 194, 433, 430

[56] References Cited

U.S. PATENT DOCUMENTS

| | | | |
|---|---|---|---|
| 1,153,760 | 9/1915 | Butler | 33/370 |
| 1,445,460 | 2/1923 | Stubblefield | 33/479 |
| 1,990,040 | 2/1935 | Launay | 33/433 |

FOREIGN PATENT DOCUMENTS

| | | | |
|---|---|---|---|
| 252980 | 3/1911 | Fed. Rep. of Germany | 33/479 |

*Primary Examiner*—Charles E. Phillips
*Attorney, Agent, or Firm*—Robert F. Hause

[57] ABSTRACT

A large T-square having retractable pins for temporary attachment of the T-square to the face of a product such as a gypsum wallboard.

2 Claims, 5 Drawing Figures

WALLBOARD T-SQUARE

This invention relates to an improved large T-square, as used for cutting straight across the width of a gypsum wallboard with a board knife, having tiny retractable pins for holding the T-square to the wallboard face.

In cutting gypsum wallboard, a T-square is used to guide the board knife as it is pulled along the face of the board. If the T-square is not held very firmly at the same time as the knife is being pulled along, the T-square can easily shift a little, causing the knife to cut other than where desired, damaging the board.

The present invention contemplates fixing a plurality of tiny pins to the long arm of the T-square in a manner such that the pins can engage the wallboard face, holding the T-square firmly relative to the wallboard face.

It is an object of the present invention to provide an improved wallboard T-square.

It is a further object of the invention to provide an improved method of cutting wallboard.

These and other objects and advantages will become apparent from the following description and drawings of a preferred embodiment, in which.

Figure 1:
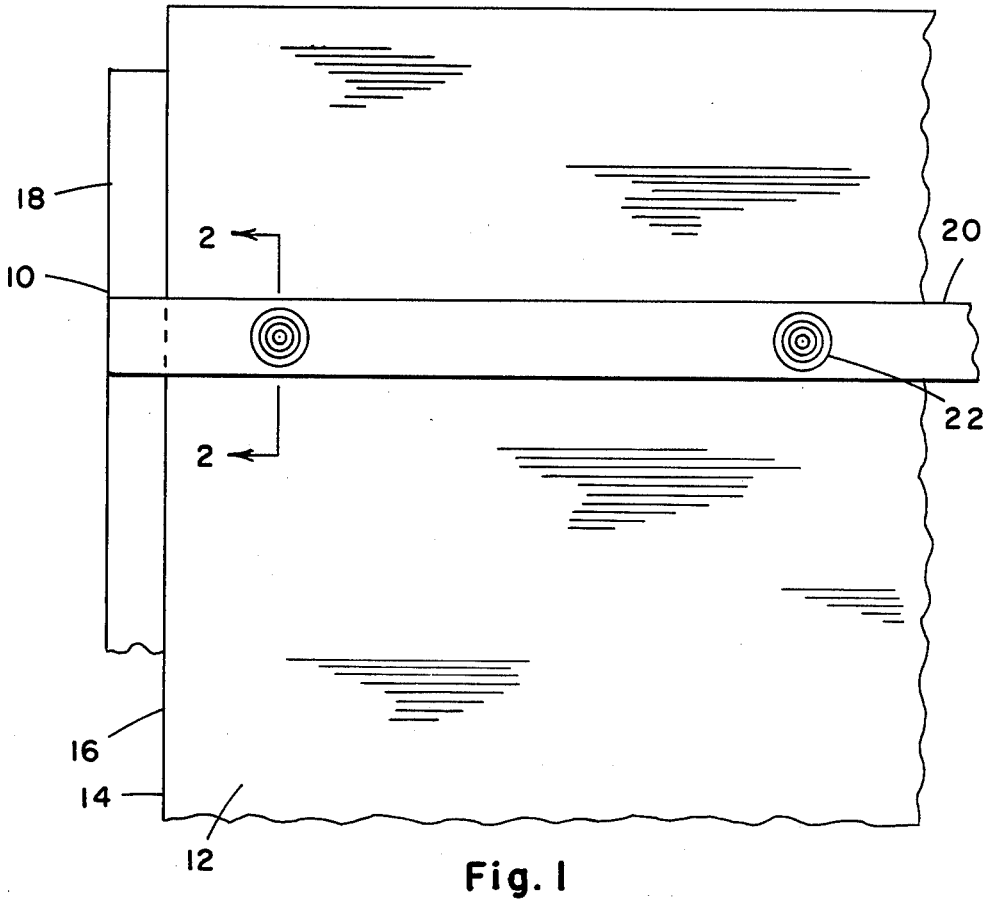
FIG. 1 is a top view of a T-square embodying the present invention disposed on the face of a gypsum wallboard.

Referring to the drawings, there is shown a large metal T-square 10 disposed against the face 12 and one side edge 14 of a gypsum wallboard 16. T-square 10 includes an edge abutting portion 18 and, at a right angle thereto, a main elongate body portion 20 which extends completely across the width of wallboard 16, such as four foot wide gypsum wallboard.

A plurality of retractable pin assemblies 22 are mounted at spaced positions along the length of body portion 20. Each pin assembly 22 is screw attached, at a position which is centered over a hole 24 extending through body portion 20. In the preferred form, pin assembly 22 includes an outer shell 26 which is screw attached to body portion 20 and an inner body 28 which is threadedly mounted within the outer shell 26 by threads 30 on the exterior of inner body 28 and threads 32 on the inner surface of outer shell 26.

Each pin assembly body 28 is formed as a hollow, cylindrical insert retainer having an externally threaded tubular portion 34 and, atop thereof, a short, slightly larger diameter, neck portion 36. The inside diameter of the hollow body 28 is slightly greater in the tubular portion 34 than in the neck portion 36.

A shallow elongate slot 38 extending across the top surface of neck portion 36 provides for insertion and removal by screwdriver of the body 28 relative to shell 26.

A shallow elongate recess 40 extends axially along the inner wall 42 of the tubular portion 34, from the bottom 44 of tubular portion 34 substantially to the junction with neck portion 36. A short, shallow sidewardly extending recess 46 connects with elongate recess 40, near, but spaced from, bottom 44.

An axially movable, replaceable, solid, cylindrical insert 50 is mounted within the hollow body 28. Insert 50 has a large diameter central portion 52, having a diameter substantially equal to the inside diameter of tubular portion 34. A short post 54 extends outwardly from central portion 52 and has a size adapted to fit and move within elongate recess 40 and sideward recess 46.

Insert 50 has an upper small diameter portion 56 adapted to extend through the neck portion 36 of body 28, and a lower small diameter portion 58 adapted to extend through the hole 24.

A very small diameter, sharp pin 60 extends downward from the bottom of insert 50. A coil spring 62 is disposed between the lower small diameter portion 58 and the inner wall 42 extending downward from the shoulder 64 at the juncture of central portion 52 and lower portion 58, down to the shoulder 66 adjacent hole 24.

Coil spring 62 is of a size and sufficiently compressible to permit the insert 50 to be pushed down to where post 54 can move down within recess 40 to sideward recess 46, whereat a slight clockwise rotation of insert 50 engages post 54 in sideward recess 46. In this operative position of insert 50, the pin 60 extends approximately one-quarter inch below the bottom surface of body portion 20, and thus about one-quarter inch into the wallboard 16. In this operative position, the upper small diameter portion 56 still extends completely through neck portion 36 and sufficiently thereabove to permit operation of the insert 50 by placement of a screwdriver in small shallow elongate slot 68 on the top surface thereof or by merely fingertip operation.

Counterclockwise rotation of insert 50, while in the operative position, moves post 54 out of sideward recess 46, and permits coil spring 62 to raise insert 50 a distance at least sufficient to completely retract pin 60 from wallboard 16, and preferably sufficient to retract pin 60 back through the hole 24, for safety reasons.

Figure 2:
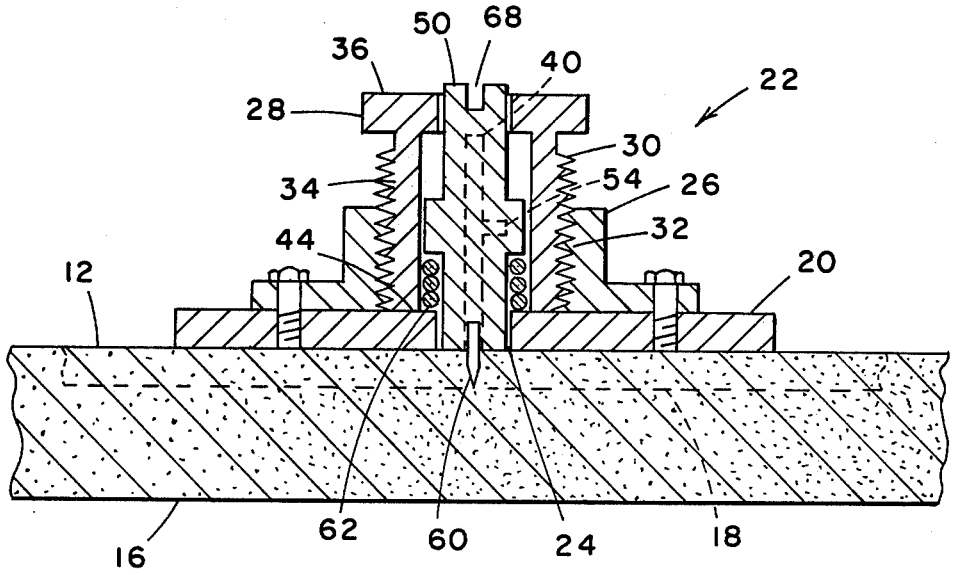
FIG. 2 is a cross-sectional end view of the T-square and wallboard of FIG. 1, taken along line 2—2, with the T-square affixed to the wallboard in accordance with the invention.
Figure 3:
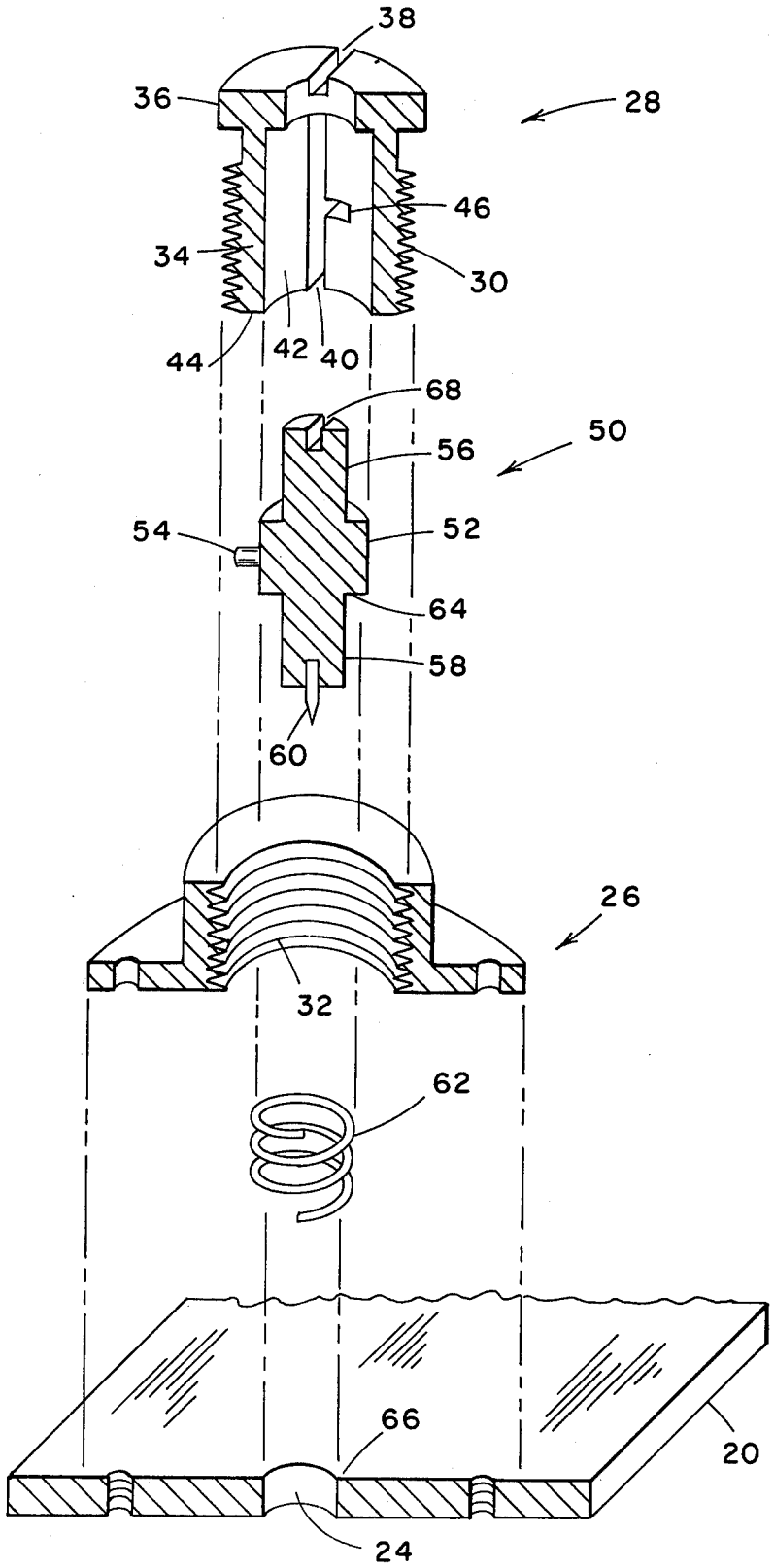
FIG. 3 is an exploded isometric cross-sectional view of a section of the T-square of FIG. 1, also taken along line 2—2.

As shown in FIG. 3, slot 40 extends to the bottom of tubular portion 34 so that insert 50, with its outwardly projecting post 54, can be inserted into tubular portion 34, during initial fabrication. As will be seen in FIGS. 2 and 3, the post 54 is engaged in a sideward recess 46, when the pin is in operative position, and disposing the pin into sideward recess will be seen to be accomplished easily by the fact that the post and the side recess become aligned when the bottom face of insert 50 abuts the top face 12 of wallboard 16.

Figure 4:
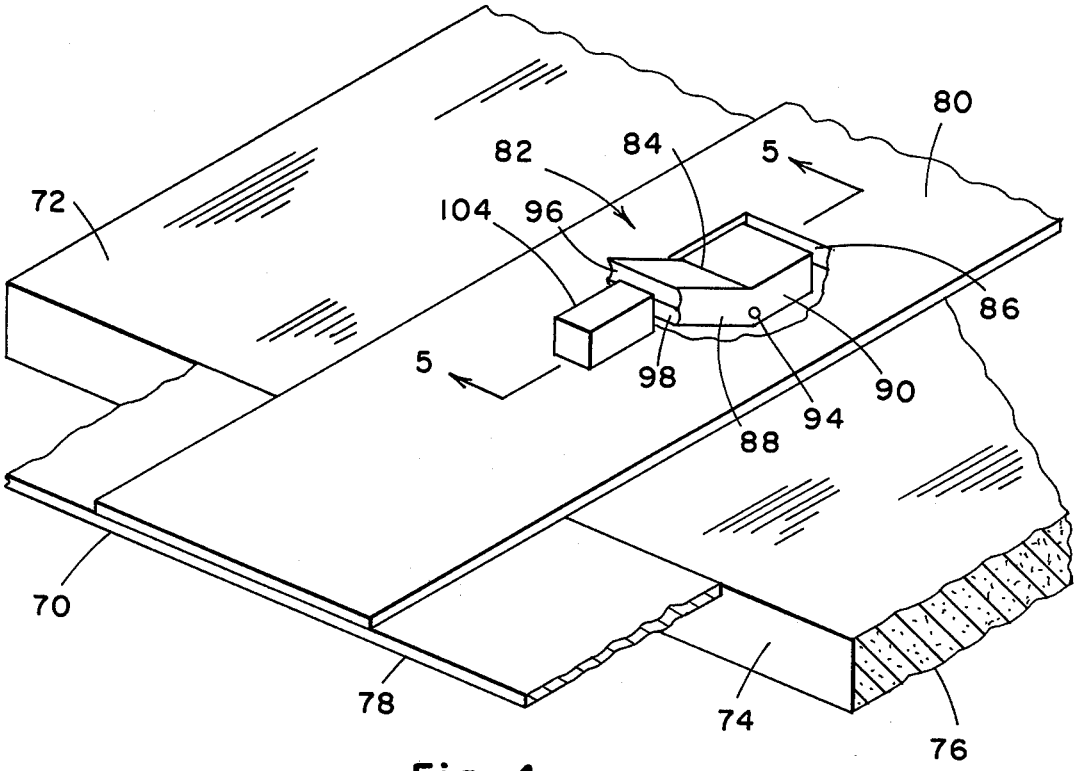
FIG. 4 is an isometric view of a section of a modified form of T-square in accordance with the invention.
Figure 5:
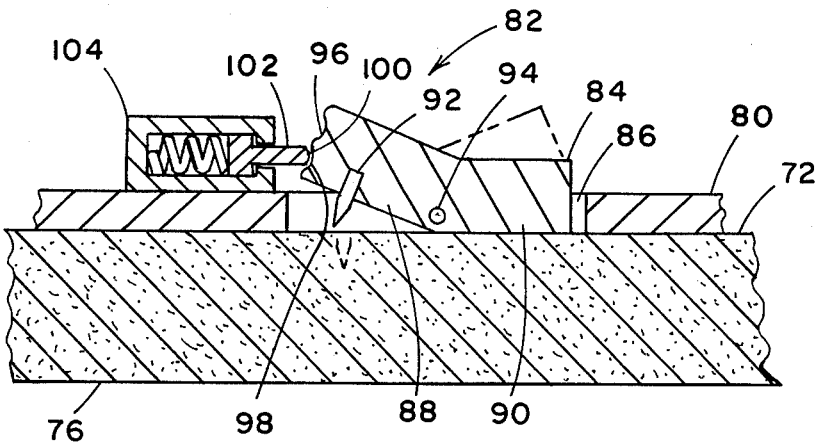
FIG. 5 is a cross-sectional view of the modified T-square of FIG. 4, taken along line 5—5.

Referring now to FIGS. 4 and 5, an alternative embodiment is shown wherein a large metal T-square 70 is disposed against the face 72 and one side edge 74 of a gypsum wallboard 76. T-square 70 includes edge abutting portion 78 and main body portion 80.

A plurality of tiltable pin assemblies 82 are mounted at spaced positions along the length of body portion 80. Each tiltable pin assembly 82 includes a pivotally mounted angled bar 84, centrally pivotally mounted in an opening 86 in body portion 80. Angle bar 84 includes two obtusely angled end portions 88, 90.

On the underside of angled end portion 88 is a small diameter, sharp pin 92, of about one-quarter inch length. Angled bar 84 is centrally, pivotally mounted on axis 94, which is affixed to main body portion 80.

At one end of angled bar 84 there are two grooves 96, 98, one above the other, each of which are positioned to engage a hemispherical end 100 on plunger 102.

Plunger 102 is mounted in housing 104, with a coil spring urging the plunger against the end of angled bar 84. When angled bar 84 is rotated around axis 94, pin 92 enters or retracts from the wallboard 76. Plunger 102 engages groove 96 when pin 92 is extending into the wallboard and engages groove 98 when the pin 92 is fully retracted.

The use of the T-square 70 will be understood to be essentially the same as the operation of the T-square 10. In using T-square 10, the edge-abutting portion 18 is placed against an edge 14 of wallboard 16, and body portion 20 is placed to extend across the face 12 of wallboard 16.

The T-square 10 can have any number of retractable pin assemblies 22, at least two being preferred. The pins 60, of each pin assembly 22, are lowered as far as possible to thus penetrate into the wallboard 16. A common board knife, not shown, is then moved along the edge of the body portion 20 with the sharp edge thereof cutting the face of the wallboard. The pins 60 are then retracted, the T-square 10 is removed from the wallboard, and the wallboard is folded in the usual manner at the cut, causing the wallboard core to sever along the line of the cut.

Having completed a detailed description of the preferred embodiment of our invention so that those skilled in the art may practice the same, we contemplate that variations may be made without departing from the essence of the invention or the scope of the appended claims.

We claim:

1. An improved T-square comprising an edge abutting portion and a main elongate body portion extending at an angle to said edge abutting portion, said body portion having at least one retractable pin assembly mounted thereon, said pin assembly including a small diameter sharp pin and means for lowering and retracting said pin, whereby said pin may be lowered sufficiently to push said pin into a board disposed under said body portion and may be retracted sufficiently to withdraw said pins to above the bottom side of said body portion, said means for lowering and retracting said pin being comprised of a hollow retainer, an axially movable insert in said retainer, said pin being mounted in the bottom of said insert, said insert including a post extending radially outward from the side thereof, said retainer including an axially extending recess in an inner wall and a short sidewardly extending recess connected with said axially extending recess, said pin being slidably disposed within said recesses, and spring means disposed to retract said movable insert and said pin when said post is disposed in the axially extending recess and to be held in a restrained position when said post is disposed in the short sidewardly extending recess.

2. In combination a wallboard and a T-square as defined in claim 1, said T-square having said edge abutting portion disposed in edge abutting relationship to an edge of said wallboard and said main elongate body portion disposed along the face of said wallboard, said T-square sharp pins being in a lowered position and penetrating about one-quarter inch into said wallboard, whereby said T-square is held and restrained against movement along the face of said wallboard.

* * * * *